US005266922A

United States Patent [19]

Smith et al.

[11] Patent Number: 5,266,922

[45] Date of Patent: Nov. 30, 1993

[54] MOBILE COMMUNICATION APPARATUS

[75] Inventors: Matthew Smith, Monroe, N.Y.; Kazushi Tabe, Kanagawa, Japan

[73] Assignee: Sony Electronics, Inc., Park Ridge, N.J.

[21] Appl. No.: 672,930

[22] Filed: Mar. 21, 1991

[51] Int. Cl.[5] ..... G08B 25/00

[52] U.S. Cl. ..... 340/525; 340/901; 455/54.1

[58] Field of Search ..... 455/54.1, 297, 238.1; 340/425.5, 426, 539, 932.2, 615, 525, 901, 705; 379/59, 63, 96, 112, 136; 387/86; 342/457

[56] References Cited

U.S. PATENT DOCUMENTS

| | | | |
|---|---|---|---|
| 4,083,003 | 4/1978 | Haemmig | 455/54.1 |
| 4,156,867 | 5/1979 | Bench et al. | 455/54.1 |
| 4,515,994 | 5/1985 | Bolle et al. | 379/63 |
| 4,517,561 | 5/1985 | Burke et al. | 379/63 |
| 4,896,370 | 1/1990 | Kasparian et al. | 379/59 |
| 4,904,992 | 2/1990 | Grothause | 455/297 |

*Primary Examiner*—Curtis Kuntz
*Assistant Examiner*—Don N. Vo
*Attorney, Agent, or Firm*—William S. Frommer; Alvin Sinderbrand

[57] ABSTRACT

Mobile communication apparatus for use on a vehicle for receiving and transmitting a signal has a transmit/-display terminal which is disabled when vehicle motion is permitted. More specifically, a transmitted signal is received, processed and supplied to the display terminal only if a sensor device indicates that vehicle motion is inhibited. If, however, the sensor device indicates that vehicle motion is permitted, the display terminal is disabled and an audible or other signal is generated to announce reception of the signal. Upon hearing the audible signal, the driver of the vehicle may park the vehicle at a convenient location, at which time the processed signal is displayed. Similarly, a unit for transmitting driver initiated signals is inhibited if the sensor device indicates that vehicle motion is permitted, and is enabled if the sensor device indicates that vehicle motion is inhibited.

14 Claims, 6 Drawing Sheets

| PACKET START FLAG 7E (HEX) | ADDRESS FIELD | BLOCK SEQUENCE NUMBER | SELECTOR FIELD | DATA FIELD | CHECKSUM FIELD | PACKET END FLAG 7E (HEX) |
|---|---|---|---|---|---|---|
| 8 BITS | 16 BITS | 6 BITS | 2 BITS | 762 BITS MAXIMUM | 6 BITS | 8 BITS |

FIG.3A

1024 DATA BITS (MAX)

| FIELD DESCRIPTION | ACQUISITION SEQUENCE | SYNC SEQUENCE | LENGTH | ROUTING ADDR | PHYSICAL ADDR | FORMAT SELECTOR | BLOCK SEQUENCE# | INTERNAL DIAD | APPLICATION PACKET | ORC | FEC |
|---|---|---|---|---|---|---|---|---|---|---|---|
| NUMBER OF BITS | 4108 CHIPS | 40,960 CHIPS | 8 | 24 | 48 | 4 | 4 | VAR | VAR | 16 | 7 |

FIG.3B

MOBILE COMMUNICATION APPARATUS

BACKGROUND OF THE INVENTION

1. Field of the Invention

The present invention relates to an improved mobile communication apparatus for use on a mobile vehicle such as, for example, a delivery truck.

2. Description of the Prior Art

It is frequently desirable to communicate with a driver of a vehicle while the driver is on the road. For example, it may be necessary to inform the driver of a recent delivery or pick-up change, or it may be desirable to know the driver's current position so as to update delivery schedules. While two-way radios, for example, citizen band radios, permit communication with a driver, they are limited in transmission range which typically inhibits direct communication between the driver and a central office. Further, as the driver may not know his current position, either in terms of standard grid coordinates or other identifying means, the driver's current position cannot be accurately updated.

To overcome the above problems, the assignee of the present application introduced a satellite communication system which generally comprises a mobile communication unit, known as the Sony 2-Wayfarer TM Mobile Communication Unit, a geosynchronous satellite, a communication center and tracking software contained within a processing device located at a user's operation center. This communication system enables messages transmitted from the user's operation center to be received at a mobile vehicle and further enables vehicle positioning data, driver initiated messages and externally sensed information to be transmitted from the vehicle to the user's operations center. As shown in FIG. 1, the mentioned satellite communication system 5 permits two-way communication between a driver in a vehicle 10 and a remote operation center 25 by way of a geosynchronous satellite 20 and a communication center 15. More specifically, operation center 25 may communicate with communication center 15 by way of telephone lines (not shown), or similar medium, and center 15 communicates with vehicle 10 by way of satellite 20.

FIG. 2 illustrates a mobile communication unit 45 according to the prior art, which may constitute the Sony 2-Wayfarer TM unit, and which generally comprises a Loran-C receiving antenna 50, a main processing unit 55, for example, in the form of a suitable microprocessor, a receiver/interface unit 60, a transmit/-receive antenna 65 and an enhanced keyboard/display unit 70. Radio waves transmitted by Loran-C stations (not shown) are received by Loran-C antenna 50 and supplied to main processing unit 55 through a cable 51, which is preferably a coaxial cable. Upon receipt of a request signal from the operation center 25 (FIG. 1) such as a vehicle positioning request signal, as hereinafter described, the processing unit 55 is adapted to calculate the current vehicle position from the received Loran-C radio waves and to process the position information into a digital signal which is supplied to the transmit/receive antenna 65, whereupon the digital signal is amplified and suitably transmitted to the satellite 20 (FIG. 1). Processing unit 55 is further adapted to receive information from sensor devices (not shown) located on the vehicle, which may be used for monitoring various functions of the vehicle, for example, the engine temperature. Signals requesting such information, like the vehicle positioning request signals, are supplied from center 25, by way of communication center 15 and satellite 20, through the transmit/receive antenna 65 to receiver/interface unit 60, as hereinafter described, whereupon the request signal is forwarded to processing unit 55. Upon receipt of such a requested signal, unit 55 processes the received engine temperature or other sensor information into a digital signal which is suitably processed and supplied to transmit/receive antenna 65 for transmission to satellite 20 as previously described. The processed digital signal may include a portion having an unique address code for identifying the transmitting vehicle, as hereinafter described.

Transmit/receive antenna 65 is further adapted to receive from satellite 20 signals which may contain a vehicle identifying address code, and to supply the received signals to receiver/interface unit 60. Unit 60 determines if the address code contained within the received signal matches that associated with the respective vehicle and which may be stored in a non-volatile memory (not shown) contained within unit 60. If a match is detected, unit 60 processes the received signal and supplies the same to keyboard/display unit 70. Further, a plurality of group address codes in which each group address code identifies a unique group of vehicles, as hereinafter described, may be stored in a programmable memory (not shown) also contained within unit 60. Thus, a transmitted signal containing a group address code will be received, processed and supplied to keyboard/display unit 70 in each mobile communication unit 45 in which a match is detected between one of the stored address codes contained within the respective unit 60 and the group address code contained within the received signal. On the other hand, if a match is not detected, the received signal is not further processed. Thus, the transmitted signal is only processed by the receiver/interface unit 60 contained within the designated vehicle or vehicles, thereby providing reasonable security for the message sent from operation center 25 (FIG. 1).

The signals transmitted from communication center 15 to communication unit 45 by way of satellite 20 are typically formatted into packets of information as shown in FIG. 3A. As shown therein, each packet includes an 8 bit start flag at the leftmost position which may have the value of $01111110_2$, or $7E_{HEX}$. Adjacent to the start flag is a 16 bit address field which contains the address of a designated vehicle or a designated group of vehicles. Alternatively, the address field may address all vehicles by utilizing, for example, an address consisting of all one's. As shown in FIG. 3A, each packet of the signal further includes a 6-bit block sequence number, a 2-bit selector field, a data field for containing information data in 6-bit bytes up to a maximum of 762 bits, a 6-bit checksum field and an 8-bit end flag which may have the same value as the start flag. Insertions of zeros from the start of the address field to the end of the checksum field in each packet is performed in accordance with the high-level data link control (HDLC) standard so as to prevent "false flags" from occurring. In a sequence of packets, the end flag of one packet may be used as the start flag of the subsequent packet. Further, during idle periods, that is, when no information data are sent from communication center 15, vehicle 10 receives a steady stream of flags from communication center 15.

The signals transmitted from communication unit 45 to communication center 15 by way of satellite 20 are typically formatted into packets of information as shown in FIG. 3B. As shown therein, each packet includes an acquisition sequence which enables the communication center 15 to acquire the transmitted signal. A synchronization sequence follows the acquisition sequence and is utilized to enable the communication center 15 to become synchronized with the received signal. Following the synchronization sequence is a length field which indicates the length of the packet, a routing address field which provides routing information, a physical address field which contains the identifying address of the respective communication unit 45 transmitting the current signal, a format selector which indicates the format of the following block sequence number and the internal diad, a block sequence number which indicates a sequential number for each packet, an internal diad field which contains application layer information relating to the respective communication unit 45 and which may include hardware status, sensor status and position information, an application packet which also contains application layer information and which may include data or messages from the keyboard/display unit 70, a cyclic redundancy check (CRC) field which contains error detection information and a forward error correction (FEC) field which contains the flush bits of the error correction encoding. The number of bits in each of the above described portions or fields is indicated in FIG. 3B. As shown therein, the maximum number of data bits from the length field through the CRC field is 1024 bits.

The receiver/interface unit 60 may contain an intelligent interface processor (not shown) for enabling devices external to communication unit 45, for example, a refrigerator unit, to be monitored and controlled in a manner similar to that previously described. Keyboard-/display unit 70 is adapted to receive and display the processed signal from unit 60 which allows the respective message to be read by the driver. For that purpose, the unit 70 is located in relatively close proximity to the driver. Associated with unit 70 is an audio or visual alarm (not shown) which is activated when a processed signal is received by unit 70, so as to alert the driver to the reception of a message. Unit 70 is further adapted to receive driver initiated messages, which are entered through a keyboard device. Such entered messages are supplied through unit 60 to processing unit 55, whereupon the messages are processed to form a digital signal supplied to antenna 65 for transmission to operation center 25 as previously described.

As previously mentioned and as shown in FIG. 1, geosynchronous satellite 20 receives digital signals transmitted from vehicle 10 and communication center 15 and, in turn, amplifies and relays the digital signals to communication center 15 and vehicle 10, respectively. By using geosynchronous satellite 20, two-way communication is effected between an operation center and a vehicle located over a relatively large predetermined area, for example, within the continental United States. Further, two geosynchronous satellites may be advantageously utilized, that is, one for receiving messages from vehicle 10 and for relaying the same to communication center 15 and one for receiving messages from communication center 15 and for relaying the same to vehicle 10.

Communication center 15 (FIG. 1) receives a transmitted signal from satellite 20 and identifies the designated user from the address code contained therein, whereupon the signal is routed to the designated user by way of telephone lines, or similar medium. In a similar manner, center 15 receives signals from a plurality of operation centers, such as operation center 25, and such signals are, in turn, transmitted to satellite 20.

Operation center 25 (FIG. 1) transmits signals to center 15 for transmission to a designated vehicle. These signals may request a vehicle's position, control a desired function or supply the driver with information as previously described. Further, center 25 receives signals from vehicle 10 by way of satellite 20 and center 15, and such signals are supplied to a central processing device (not shown) located in center 25. The received signals are processed by the central processing device, which includes tracking software, and may be displayed on a detailed map along with any messages or data which may have been transmitted.

Thus, while the 2-Wayfarer TM Communication Unit, when used with satellite 20, center 15 and a processing device containing tracking software, enables two-way communication between a vehicle and an operation center, it may give rise to a safety hazard if the driver seeks to read transmitted messages from the keyboard/display unit 70, or seeks to transmit messages by way of the keyboard thereof, while vehicle movement is possible.

OBJECTS AND SUMMARY OF THE INVENTION

Accordingly, it is an object of the present invention to provide a mobile communication apparatus which avoids the above-mentioned disadvantages of the prior art.

More specifically, it is an object of the present invention to provide a mobile communication apparatus for use on a vehicle and which inhibits the use of a display and keyboard device when the vehicle is in motion or such motion is permitted.

It is another object of the present invention to provide a mobile communication apparatus for use on a vehicle, as aforesaid, and which provides an audible signal when a message is received while vehicle motion is permitted.

It is yet a further object of the present invention to provide a mobile communication apparatus for use on a vehicle and which provides a plurality of audible signals by which the driver is alerted to the urgency of a received signal while the vehicle is in motion or such motion is permitted.

According to an aspect of the present invention, a mobile communication apparatus provided on a vehicle for transmitting and receiving a signal and which has keyboard means for generating a user initiated signal, transmitting means for transmitting the user initiated signal, receiving means for receiving a transmitted signal and a display unit for displaying the received signal, is further provided with sensor means for sensing inhibition of the motion of the vehicle, and means responsive to the sensor means for enabling the received signal to be displayed by the display unit and the keyboard means to be operative for generating the user initiated signal only when vehicle motion is inhibited.

The above, and other objects, features and advantages of the present invention, will be apparent in the following detailed description of a preferred embodiment of the present invention when read in conjunction with accompanying drawings in which corresponding parts are identified by the same reference numerals.

BRIEF DESCRIPTION OF THE DRAWINGS

FIGS. 3A and 3B illustrate signal formats;

DETAILED DESCRIPTION OF THE PREFERRED EMBODIMENTS

An improved mobile communication unit 100 according to an embodiment of the present invention will now be described in detail with reference to FIGS. 4–6.

Figure 2:
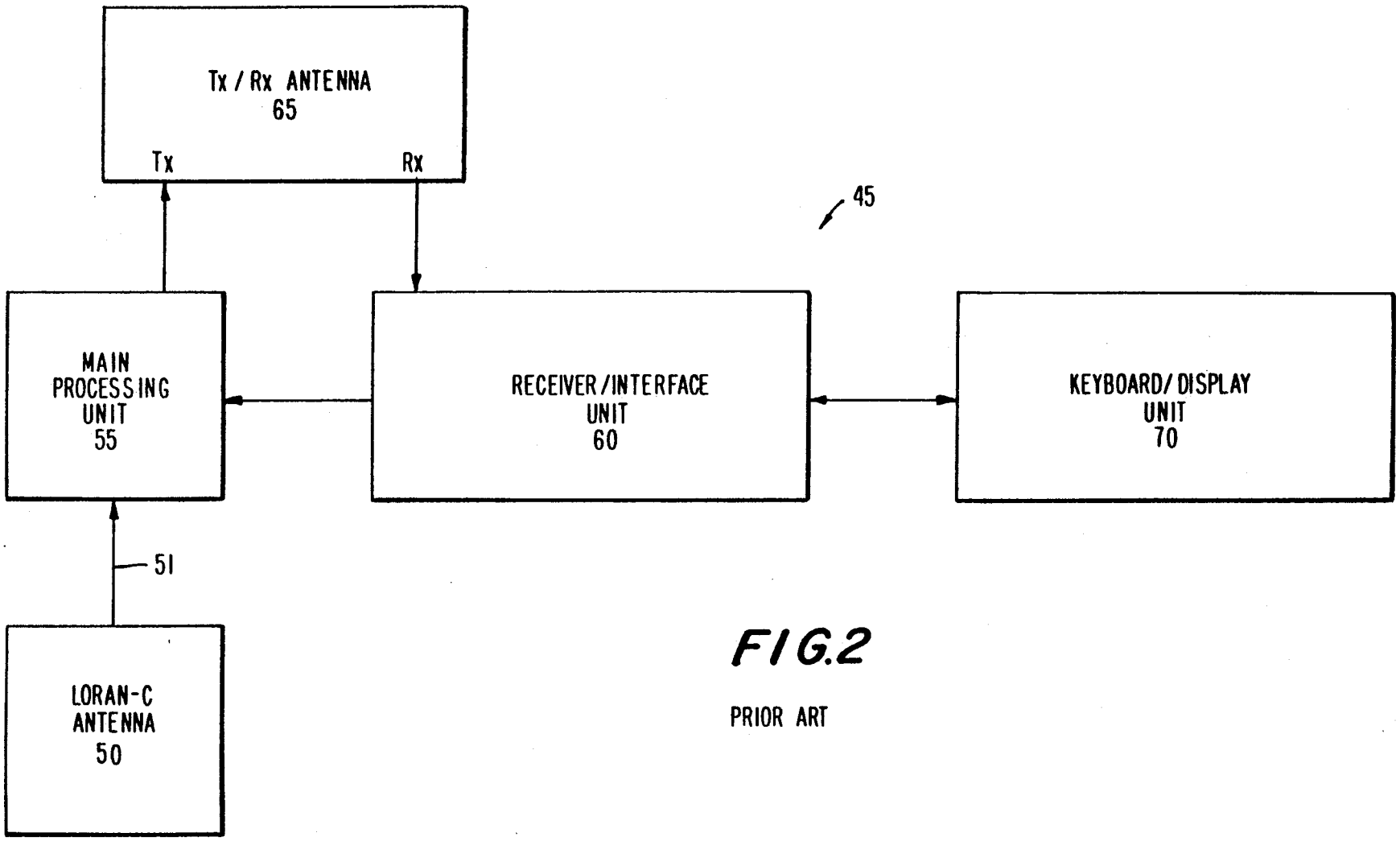
FIG.2 PRIOR ART
FIG. 2 illustrates a mobile communication unit according to the prior art that has been used in the system of FIG. 1.
Figure 4:
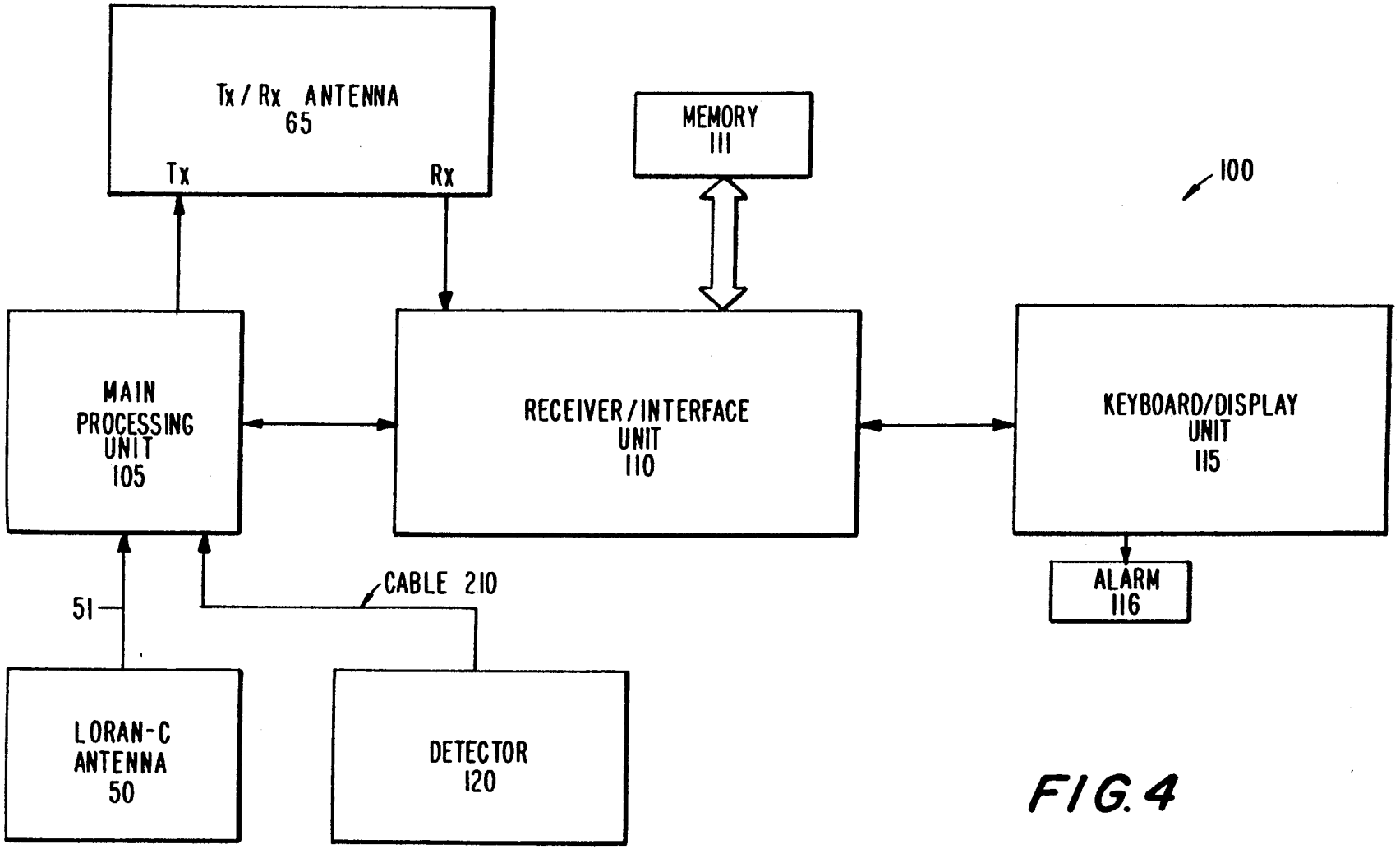
FIG. 4 illustrates a mobile communication unit according to an embodiment of the present invention.
Figure 5:
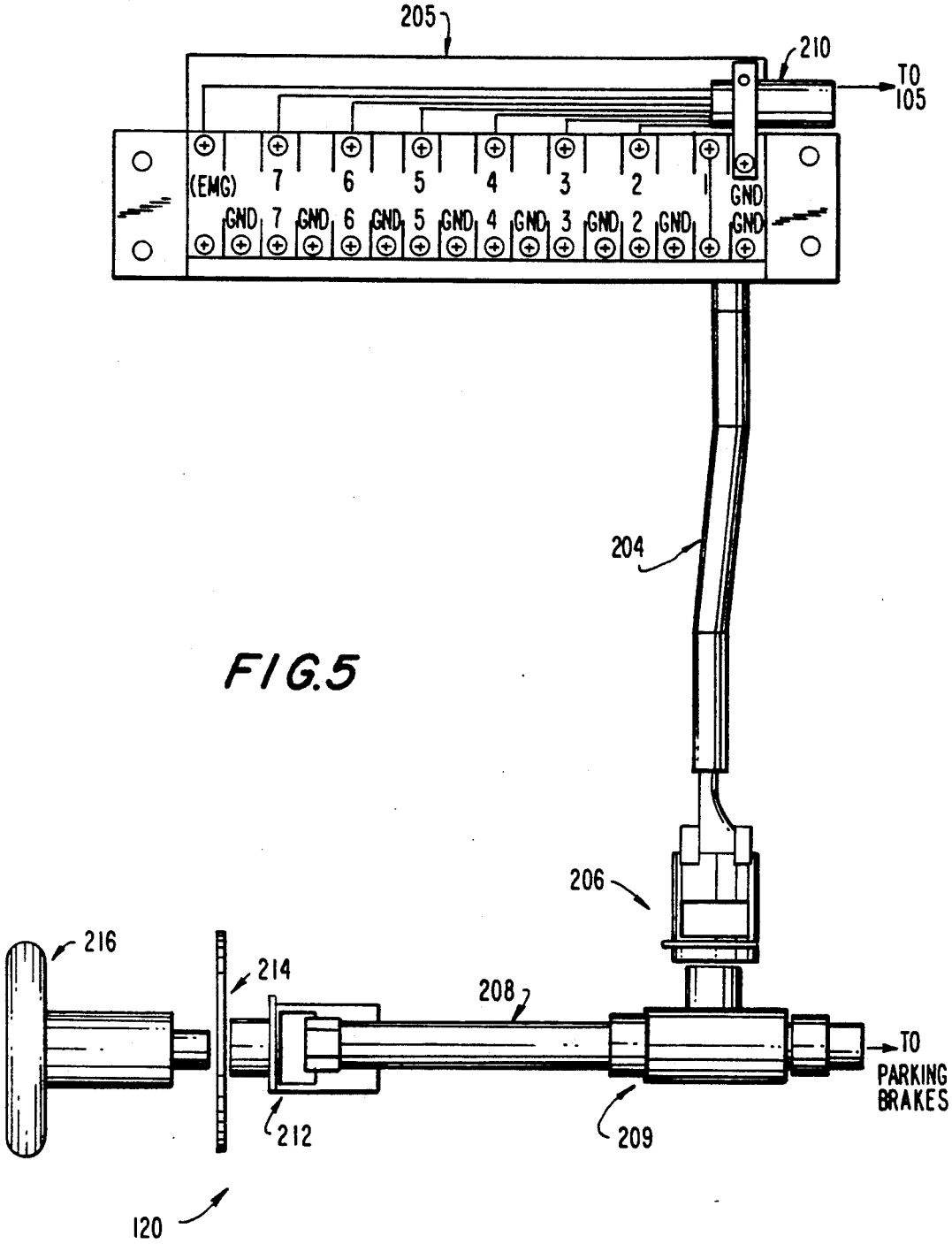
FIG. 5 illustrates a vehicle motion inhibiting detector which may be used in the mobile communication unit of FIG. 4.

As shown in FIG. 4, the mobile communication unit 100 includes components similar to those included in the known mobile communication unit 45 (FIG. 2) and, therefore, a description of those components will not be repeated. Further, the processing unit 55 and receiver-/interface unit 60 of FIG. 2 generally correspond to a main processing unit 105 and a receiver/interface unit 110, respectively, included in the communication unit 100 and only the differences between these corresponding units will be described. Communication unit 100 according to the invention is further shown to include a detector 120 which, in a preferred embodiment, is adapted to detect the inhibition of vehicle motion and to supply a signal having different states indicating when vehicle motion is inhibited and permitted, respectively, to the processing unit 105.

Figure 1:
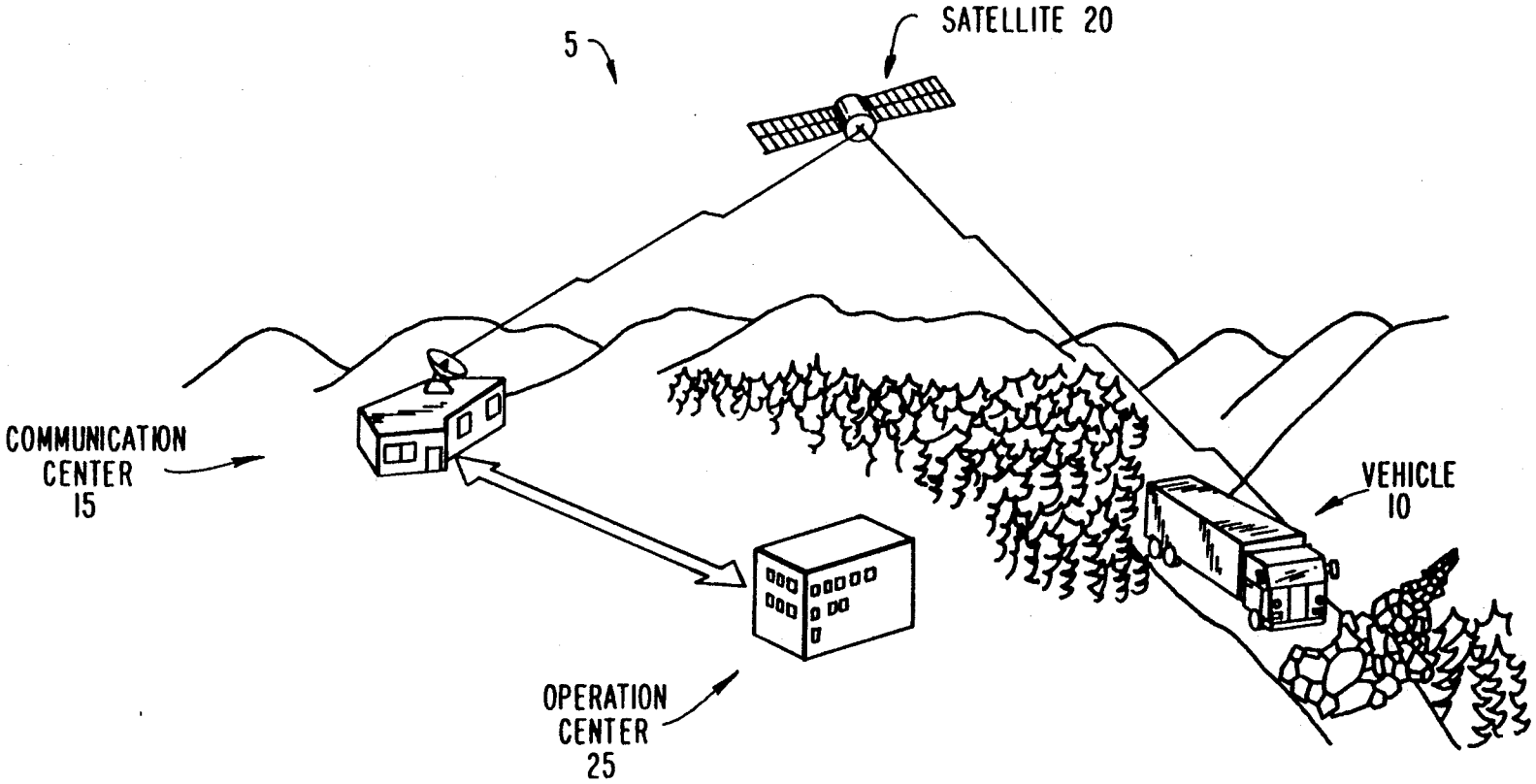
FIG. 1 schematically illustrates a satellite communication system of a type to which the present invention may be applied.

In a preferred embodiment, detector 120 detects when the parking brakes of vehicle 10 are in a set state or a released state. As is to be appreciated, when the parking brakes of vehicle 10 are set, the vehicle is typically inhibited from moving. On the other hand, when the parking brakes are released, vehicle 10 is permitted to move. More specifically, as shown in FIG. 5, detector 120 includes a sensor terminal block 205 mechanically fastened to vehicle 10 (FIG. 1) and preferably positioned in relatively close proximity to the processing unit 105. Terminal block 205 is connected by a cable 204 to an in-line pressure switch 206 which is adapted to detect changes in pressure and to supply a signal indicating such pressure changes through cable 204 to terminal block 205. In-line pressure switch 206 is coupled through a brake line coupler 209 to a brake air line 208 which, in turn, is connected to selected brakes (not shown) of vehicle 10. Brake air line 208 is connected to a pressure switch 212 which is adapted to change the air pressure within brake air line 208 in response to a signal caused by a driver engaging or disengaging a parking brake lever 216 located in the driver's compartment of vehicle 10, that is, on the driver's side of a dashboard 214. Thus, by engaging the parking brake lever 216 which, in turn, causes the pressure switch 212 to change the air pressure within brake air line 208 accordingly, the parking brakes are set. In-line pressure switch 206 detects this change in pressure and, as a result, transmits a signal indicating such pressure change through cable 204 to terminal sensor block 205, whereupon the signal is supplied through a cable 210 to the processing unit 105. In a similar manner, by disengaging the parking lever 216 thus causing a corresponding air pressure change in the brake air line 208 to occur, the parking brakes are released. The in-line pressure switch 206 detects this pressure change and transmits a corresponding signal to processing unit 105 as previously described. Further, in-line pressure switch 206 may be configured to supply a signal to the sensor block 205 in one state only, that is, when the parking brakes are either set or released, whereupon the processing unit 105 interprets the received signal, or the absence of a signal, accordingly.

In an alternate embodiment, detector 120 detects vehicle movement. More specifically, the sensor block 205 of detector 120 is connected by cable 204 to an electronic sensor switch (not shown) which is adapted to detect vehicle movement regardless of magnitude and which may comprise, for example, a motion detector or an axle motion sensor. If vehicle movement is detected, the sensor switch supplies a signal having a predetermined voltage level through cable 204 to terminal block 205, whereupon the signal is relayed through cable 210 to the processing unit 105.

Upon receipt of a signal indicating that vehicle motion is permitted, processing unit 105 supplies an inhibiting signal to receiver/interface unit 110 which, in turn, supplies a disabling or inhibiting signal to keyboard/display unit 115. As a result, the keyboard portion of unit 115 is inhibited from use so that a user, or driver, is prevented from entering a signal through the keyboard portion. In addition, in response to the disabling or inhibiting signal, the display portion of the keyboard-/display unit 115 is blanked and remains in this state even when a signal, which has been received by antenna 65 and processed by unit 110, is available for display by the display portion. In this situation, the processed signal may be stored in a memory 111 associated with unit 110 until the processed signal can be displayed.

On the other hand, if vehicle motion is inhibited, the in-line pressure switch 206 supplies a signal having a predetermined voltage level, which in a preferred embodiment is substantially zero volts, to processing unit 105. As a result of the zero voltage signal, processing unit 105 does not supply an inhibiting signal to receiver-/interface unit 110 which, in turn, does not supply a disabling signal to keyboard/display unit 115. Thus, unit 115 may display a processed signal received from unit 110 and may receive driver initiated signals from the keyboard portion.

When a processed signal from unit 110 is available for supply to the keyboard/display unit 115, but the detector 120 detects that vehicle motion is permitted and supplies a corresponding signal to unit 105, as described above, an alarm 116 associated with keyboard/display unit 115, and which may comprise an audible or a visual alarm, is triggered. Thus, the driver is alerted that a message has been received but cannot be displayed as vehicle motion is permitted. As a result, the driver may stop the vehicle at a convenient location and engage the parking brakes, whereupon the received message is displayed by unit 115. More specifically, when the parking brakes of vehicle 10 are engaged, detector 120 supplies a zero voltage signal to unit 105 which, in turn, permits the processed signal from unit 110 to be displayed on unit 115, as previously described.

The alarm 116 associated with the keyboard/display unit 115 may provide multiple types of signals for indicating the type of message received. More specifically, the transmitted signal from center 25 may include a portion for indicating the type of alarm signal to be activated by unit 115, if vehicle motion is permitted when the transmitted signal is received by the communication unit 100. For example, a first type of audible signal may indicate a "normal" message, whereas a second type of alarm may indicate an "emergency" message. Thus, the driver is provided with an indication of the type of undisplayed message which has been received and the driver may plan the stopping of the vehicle accordingly.

Figure 6:
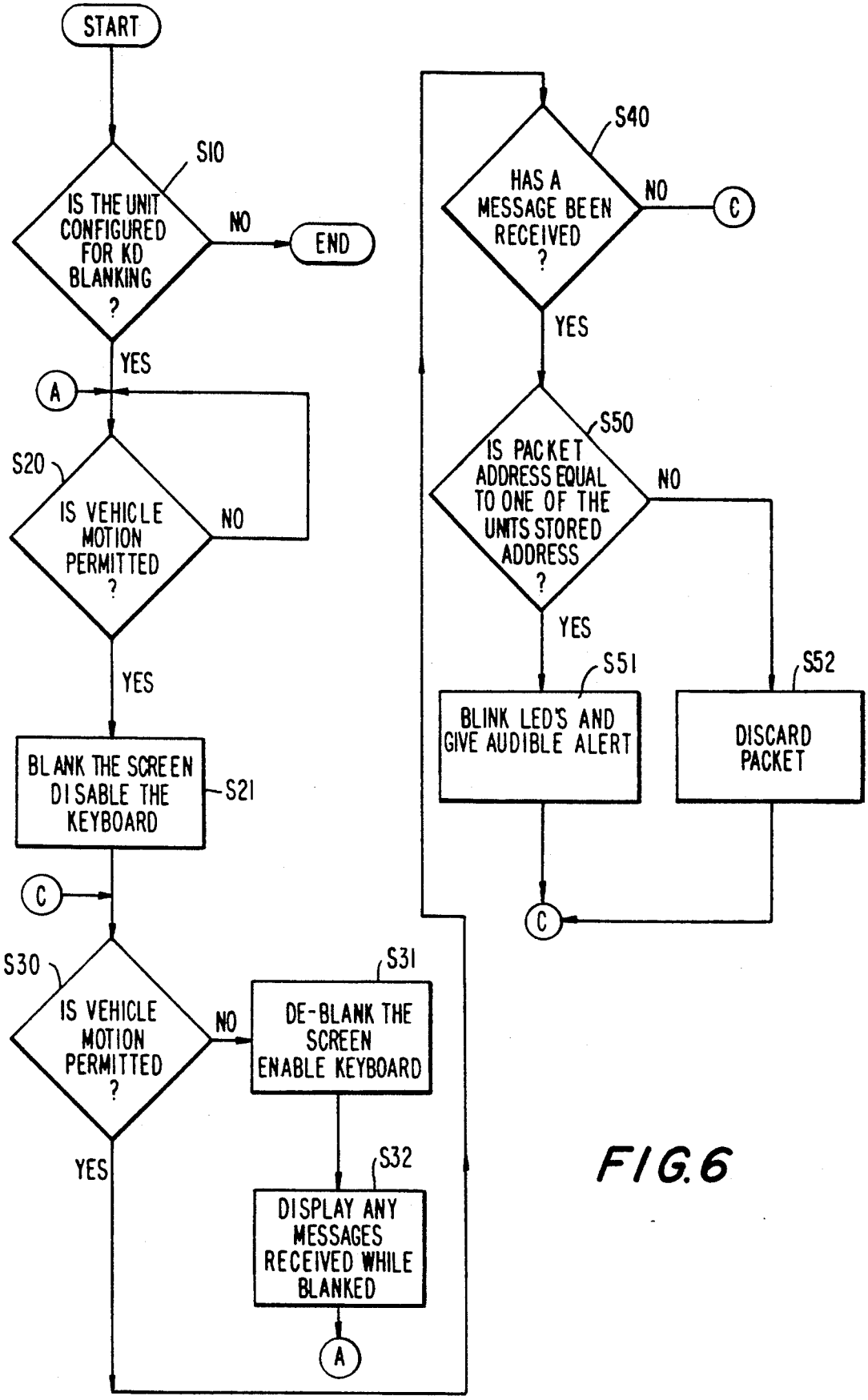
FIG. 6 is a flow chart to which reference will be made in explaining the operation of the mobile communication unit of FIG. 4.

The above-described processing is desirably controlled by software which is loaded into main processing unit 105 and receiver/interface unit 110 A flow chart for the software is illustrated in FIG. 6, which will now be described.

Upon activating the mobile communication unit 100 (FIG. 4), it is determined in a step S10 whether or not the keyboard/display (KD) unit 115 can be disabled if required. If a NO answer is obtained in step S10, processing is terminated, whereupon an indication, for example, an error message is provided so as to alert the user that unit 100 is not operating properly. However, if a YES answer is obtained in step S10, that is, it is determined that unit 115 may be disabled, processing continues to step S20.

At step S20, a determination of whether or not vehicle motion is permitted is performed. If vehicle motion is permitted, so that a YES answer is obtained in step S20, keyboard/display unit 115 is disabled in a step S21. As a result, the keyboard portion is inhibited from use and the display screen is blanked so as to prevent messages from being displayed thereon. Processing then continues to a step S30. On the other hand, if a NO answer is obtained in step S20, step S20 is repeated. It is to be appreciated, that when vehicle motion is not permitted, as indicated by a NO answer in step S20, keyboard/display unit 115 is operational.

At step S30, it is again determined whether or not vehicle motion is permitted. If vehicle motion is no longer permitted, so that a NO answer is obtained in step S30, the keyboard/display unit 115 is placed in an operating mode. More specifically, in a step S31 the display screen is de-blanked and the keyboard is enabled. Then, in a step S32 messages, including messages received while unit 115 was disabled, are displayed, while user initiated messages may be generated by the keyboard portion of unit 115. Processing then returns to step S20.

If a YES answer is obtained in step S30, processing proceeds to a step S40 in which it is determined whether or not a message has been received by communication unit 100 while vehicle motion was permitted. If a NO answer is obtained in step S40, processing returns directly to step S30. If a YES answer is obtained at step S40, processing proceeds to step S50.

At step S50, a determination is made whether or not the address contained within the packet of received information or signal is the same as one of the addresses stored within unit 110. If a match is detected, so that a YES answer is obtained in step S50, the alarm 116, which may produce visual and audible signals, is activated in a step S51 for notifying the driver of the received signal. Processing then returns to step S30. However, if a NO answer is obtained in the step S50, the received packet of information is discarded in a step S52 and processing returns to step S30.

In the mobile communication unit according to this invention, as described hereinabove, the keyboard/display unit 115 is disabled whenever vehicle motion is permitted. As a result, the driver is prevented from transmitting and receiving messages when vehicle motion is permitted. Further, if a message is received while vehicle motion is permitted, an alarm signal, indicating the type of message, is provided by the alarm 116 so as to alert the driver accordingly. It is to be appreciated, that several other operations, for example, supplying vehicle position information, remotely controlling a predetermined function of the vehicle and detecting and identifying an address code contained within a transmitted signal, may also be performed by the processing unit 105 in a manner similar to that previously described for the communication unit 45 according to the prior art and the description of such operations will not be here repeated.

Although the described embodiment of the present invention has been described for use with a specific mobile communication unit, that is, the Sony 2-Wayfarer TM Mobile Communication Unit, the present invention is not so limited and may also be applied to any type of display or transmitting terminal used within any type of vehicle.

Furthermore, although a preferred embodiment of the present invention has been described in detail herein with reference to the accompanying drawings, it is to be understood that the invention is not limited to that precise embodiment, and that various changes and modifications can be effected therein by one skilled in the art without departing from the scope or spirit of the invention as defined in the appended claims.

What is claimed is:

1. A mobile communication apparatus adapted to be mounted on a movable vehicle, said apparatus comprising:

sensor means for sensing inhibition of motion of said vehicle and for generating a corresponding motion inhibited signal;

means for receiving a transmitted signal and for processing the received signal so as to form a processed signal;

display means for displaying said processed signal; and means coupled to said sensor means so as to receive said motion inhibited signal for permitting the display of said processed signal by said display means only when said sensor means generates said motion inhibited signal and for inhibiting the display of said processed signal by said display means when said sensor means fails to generate said motion inhibited signal.

2. Apparatus as set forth in claim 1, in which said means for receiving and processing supplies said processed signal to said display means only when said motion-inhibited signal from said sensor means is received by said means for permitting and inhibiting.

3. Apparatus as set forth in claim 1, further comprising audible signal generating means coupled to said means for receiving and processing and said means for permitting and inhibiting for generating an audible signal when said processed signal is available for supply to said display means and when said sensor means fails to generate said motion-inhibited signal.

4. Apparatus as set forth in claim 1, in which the vehicle on which the apparatus is to be mounted has a respective identifying address and said transmitted signal includes an address portion containing the identifying address of a designated vehicle; and in which said means for receiving and processing is programmed to examine said address portion, whereupon said means for receiving and processing continues processing of said received signal only if said identifying address included in said address portion of said transmitted signal matches the respective vehicle's identifying address.

5. Apparatus as set forth in claim 1, further comprising memory means coupled to said means for permitting and inhibiting for storing said processed signal when said sensor means fails to generate said motion inhibited signal.

6. A mobile communication apparatus adapted to be contained within a movable vehicle for transmitting a signal, said apparatus comprising:

sensor means for sensing inhibition of motion of said vehicle and for generating a corresponding motion inhibition signal;

terminal means for including a keyboard device operative for generating a user initiated signal;

means coupled to said sensor means so as to receive said motion inhibited signal for permitting operation of said terminal means only when said sensor means generates said motion inhibited signal and for inhibiting operation of said terminal means when said sensor means fails to generate said motion inhibited signal;

processing means for processing said user initiated signal; and transmitting means for transmitting the processed signal.

7. A mobile communication apparatus adapted for mounting on a movable vehicle, said apparatus comprising:

receiving means for receiving a transmitted signal;

display means for displaying a received signal;

sensor means adapted for sensing inhibition of motion of said vehicle on which the apparatus is mounted and providing a control signal having a first state or indicating that vehicle motion is permitted and a second state for indicating that vehicle motion is inhibited; and means responsive to said first and second states of said control signal for respectively disabling said display means when vehicle motion is permitted and enabling said display means when vehicle motion is inhibited.

8. A mobile communication apparatus as set forth in claim 7, further comprising:

user operable keyboard means for generating a user initiated signal;

transmitted means for transmitting said user indicated signal; and means responsive to said first and second states of said control signal for also respectively disabling said keyboard means when vehicle motion is permitted and enabling said keyboard mean when vehicle motion is inhibited.

9. A mobile communication apparatus as set forth in claim 7, further comprising memory means coupled to said means for disabling and enabling for storing said received signal in response to said first state of said control signal.

10. A mobile communication system for communicating with a plurality of movable vehicles, said system comprising:

a communication center for transmitting signals to said vehicles in which each of the transmitted signals includes an address portion containing an identifying address of at least one designated vehicle and for receiving transmitted signals from said vehicles in which each of the received signals includes an address portion containing the identifying address of the respective vehicle initiating the signal transmission; and a plurality of communication devices each adapted to be mounted on a respective vehicle, each of said device including sensor means for sensing inhibition of motion of the respective vehicle on which the communication device is mounted and for generating a corresponding motion inhibited signal, receiving means for receiving the signal transmitted from said communication center, means coupled to said sensor means so as to receive said motion inhibited signal and operative for displaying the respective transmitted signals only when said sensor means generates said motion inhibited signal and for inhibiting the display of the respective transmitted signals when said sensor means fails to generate said motion inhibited signal, user operable terminal means coupled to said sensor means so as to receive said motion inhibited signal and operative for generating a user initiated signal containing the identifying address of the vehicle on which the respective device is mounted only when said sensor means generates said motion inhibited signal and for inhibiting operation thereof when said sensor means fails to generate said motion inhibited signal, and transmitting means for transmitting said user initiated signal to said communication center.

11. A mobile communication system as set forth in claim 10, in which each of said devices further includes memory means coupled to said means for displaying and inhibiting for storing the respective transmitted signals when said sensor means fails to generate said motion inhibited signal.

12. An improved mobile communication apparatus adapted for mounting on a movable vehicle for transmitting and receiving a signal and having keyboard means for generating a user initiated signal, transmitting means for transmitting said user initiated signal, receiving means for receiving a transmitted signal and a display unit for displaying the received signal, in which the improvement comprises: sensor means for sensing inhibition of motion of said vehicle, and means responsive to said sensor means for enabling said received signal to be displayed by said display unit and said keyboard means to be operative for generating said user initiated signal only when vehicle motion is inhibited.

13. An improved mobile communication apparatus as set forth in claim 12, further comprising audible signal generating means coupled to said means for enabling for generating an audible signal when said received signal is available for supply to said display unit and said sensor means indicates vehicle motion is permitted.

14. A mobile communication apparatus adapted to be mounted on a movable vehicle, said apparatus comprising:

sensor means for sensing inhibition of motion of said vehicle and for generating a corresponding motion inhibited signal;

receiving means for receiving a transmitted signal having a portion indicating a type of audible signal to be generated;

processing means for processing the received signal so as to form a processed signal and for receiving said motion inhibited signal;

display means for displaying the processed signal, said display means being inhibited from displaying said processed signal by said processing means when said processing means fails to receive said motion inhibited signal; and audible signal generating means coupled to said processing means for generating a type of audible signal selected from among a plurality of types of audible signals based upon the type of audible signal indicated by said portion when said processed signal is available for supply to said display means and when said processing means fails to receive said motion-inhibited signal.

* * * * *